US009563175B2

(12) United States Patent
Christan et al.

(10) Patent No.: US 9,563,175 B2
(45) Date of Patent: Feb. 7, 2017

(54) BALANCE SPRING STUD-HOLDER

(71) Applicant: ETA SA Manufacture Horlogere Suisse, Grenchen (CH)

(72) Inventors: Julien Christan, Bienne (CH); Laurent Kaelin, Sonvilier (CH); Ivan Villar, Brugg (CH); Thierry Conus, Lengnau (CH)

(73) Assignee: ETA SA Manufacture Horlogere Sueisse, Grenchen (CH)

( * ) Notice: Subject to any disclaimer, the term of this patent is extended or adjusted under 35 U.S.C. 154(b) by 0 days.

(21) Appl. No.: 14/976,312

(22) Filed: Dec. 21, 2015

(65) Prior Publication Data

US 2016/0179056 A1 Jun. 23, 2016

(30) Foreign Application Priority Data

Dec. 22, 2014 (EP) ..... 14199755

(51) Int. Cl.

| | |
|---|---|
| ***G04B 17/32*** | (2006.01) |
| ***G04B 37/05*** | (2006.01) |
| ***G04B 43/00*** | (2006.01) |

(52) U.S. Cl.

CPC ..... *G04B 37/05* (2013.01); *G04B 17/325* (2013.01); *G04B 43/002* (2013.01)

(58) Field of Classification Search

CPC ..... G04B 17/325; G04B 17/32; G04B 17/34; G04B 37/05; G04B 43/002

USPC ..... 368/178

See application file for complete search history.

(56) References Cited

U.S. PATENT DOCUMENTS

| | | | | |
|---|---|---|---|---|
| 221,180 | A * | 11/1879 | Doherty | G04B 17/325 368/178 |
| 224,227 | A | 2/1880 | Rivett | |
| 440,877 | A | 11/1890 | Higginbotham | |
| 3,328,955 | A * | 7/1967 | Jean-Claude Schneider | G04B 17/32 368/177 |
| 5,907,524 | A * | 5/1999 | Marmy | G04B 17/066 368/175 |
| 2004/0174775 | A1* | 9/2004 | Muller | G04B 17/063 368/177 |
| 2006/0062088 | A1* | 3/2006 | Hintze | G04B 18/023 368/175 |
| 2007/0091729 | A1* | 4/2007 | Takahashi | G04B 17/06 368/170 |
| 2015/0138931 | A1* | 5/2015 | Courvoisier | G04B 17/32 368/127 |

FOREIGN PATENT DOCUMENTS

| | | |
|---|---|---|
| CH | 42 750 | 3/1909 |
| CH | 52 751 | 1/1912 |
| CH | 609 515 | 3/1979 |

OTHER PUBLICATIONS

European Search Report issued Sep. 11, 2015 in European Application 14199755, filed on Dec. 22, 2014 ( with English Translation).

* cited by examiner

*Primary Examiner* — Sean Kayes
(74) *Attorney, Agent, or Firm* — Oblon, McClelland, Maier & Neustadt, L.L.P.

(57) ABSTRACT

An assembly for holding or supporting a timepiece balance spring including a base provided with an upper surface and a lower surface on which a balance spring stud and a stud-holder are arranged. The stud-holder secures the stud to an escapement mechanism.

24 Claims, 6 Drawing Sheets

BALANCE SPRING STUD-HOLDER

This application claims priority from European Patent application No. 14199755.1 filed Dec. 22, 2014, the entire disclosure of which is hereby incorporated herein by reference.

The present invention concerns an assembly for holding or supporting a timepiece balance spring including a balance spring stud and a stud-holder, wherein said stud-holder includes:

a base comprising a first stop member extending along a longitudinal axis of said base;

means of securing said stud-holder to an escapement mechanism.

PRIOR ART

In a mechanical watch, it is usual to use a regulating member comprising a sprung-balance device. Conventionally, the inner end of the balance spring is attached to a collet provided on the balance staff. In order to attach and position the inner end of the balance spring, it is known to use a stud-holder housing a balance spring stud, in association with a clamping screw to clamp the stud against the portion of the balance spring engaged in the stud-holder.

In such an assembly, the stud-holder is conventionally attached to a balance-cock also used for attaching one of the ends of the balance staff. In practice, during assembly and/or timing, the operations to be performed with these various elements are difficult, since access is restricted and the parts are of very small dimensions. Moreover, with such configurations, it is common for the balance spring clamping screw or the balance spring stud-holder to come loose, and/or be lost during an operation such as adjustment of the active length of the balance spring.

SUMMARY OF THE INVENTION

It is an object of the invention to overcome the drawbacks of the prior art by proposing to provide an assembly for holding or supporting a timepiece balance spring which allows simplified assembly or disassembly of the balance spring stud.

To this end, the invention concerns an assembly for holding or supporting a timepiece balance spring including a base provided with an upper surface and a lower surface on which a balance spring stud and a stud-holder are arranged, wherein the stud-holder includes:

means for securing said stud to an escapement mechanism, characterized in that the means for securing said stud include an orifice traversing said base and provided with a peripheral rim to form a housing for insertion of the stud, said means for securing said stud also including attachment means for rotatable attachment of a rotating element inside the housing, said rotating element having an outer edge cooperating with the stud to lock it between the outer edge thereof and the peripheral rim of the housing when the rotating element is assembled in the housing.

In a first advantageous embodiment, the peripheral rim is provided with a through notch in order to place the stud therein.

In a second advantageous embodiment, said rotating element is provided with a through notch in order to place the stud therein.

In a third advantageous embodiment, said rotating element is a hub.

In a fourth advantageous embodiment, said rotating element is a ring.

In a fifth advantageous embodiment, the hub includes a shock absorber system.

The invention also concerns an assembly for holding or supporting a timepiece balance spring including a base provided with an upper surface and a lower surface on which a balance spring stud and a stud-holder are arranged, wherein said stud-holder includes:

means for securing said stud to an escapement mechanism, characterized in that the means for securing said stud include a blind circular hollow formed by a bottom and a peripheral rim, arranged on the upper surface of the base forming a housing for insertion of the stud, said means for securing said stud also including attachment means for rotatable attachment of a rotating element inside the housing, said rotating element having an outer edge cooperating with the stud to lock it between the outer edge of the rotating element and the peripheral rim of the housing when the rotating element is assembled in the housing.

In a first advantageous embodiment, said rotating element is a hub.

In a second advantageous embodiment, said rotating element is a ring.

In a third advantageous embodiment, the peripheral rim is provided with a through notch in order to place the stud therein.

In a fourth advantageous embodiment, said rotating element is provided with a through notch cooperating with a hole located in the bottom of the housing in order to place the stud therein.

In a fifth advantageous embodiment, the housing is a circular hollow, formed of a peripheral rim, an inner rim and a bottom, in which the rotating element is inserted, the inner rim defining a central portion protruding from the bottom.

In another advantageous embodiment, the inner rim is provided with a through notch cooperating with a hole located in the bottom of the housing in order to place the stud therein.

In another advantageous embodiment, the bottom of the housing includes a shock absorber system.

The invention also concerns an assembly for holding or supporting a timepiece balance spring, comprising a base provided with an upper surface and a lower surface on which a stud and a stud-holder are arranged, wherein the stud-holder includes:

means for securing said stud to an escapement mechanism, characterized in that the means for securing said stud include a blind circular hollow formed by a bottom and a peripheral rim, arranged on the upper surface of the base forming a housing for insertion of the stud, said means for securing said stud also including attachment means for rotatable attachment of a rotating element inside the housing, said rotating element having an outer edge cooperating with the stud to lock it between the outer edge of the rotating element and the peripheral rim of the housing when the rotating element is assembled in the housing.

In a first advantageous embodiment, said rotating element is a hub.

In a second advantageous embodiment, said rotating element is a ring.

In a third advantageous embodiment, the peripheral rim is provided with a notch in order to place the stud therein.

In a fourth advantageous embodiment, said rotating element is provided with a through notch in order to place the stud therein.

In a fifth advantageous embodiment, the housing is a circular hollow formed of a peripheral rim, an inner rim and a bottom, in which the rotating element is inserted, the inner rim defining a central portion protruding from the bottom.

In a sixth advantageous embodiment, the inner rim is provided with a notch cooperating in order to place the stud therein.

In another advantageous embodiment, the hub includes a shock absorber system.

In another advantageous embodiment, the bottom of the housing includes a shock absorber system, the balance staff passing through the ring acting as rotating element.

In another advantageous embodiment, the central portion includes a shock absorber system.

In another advantageous embodiment, the peripheral rim includes at least one cavity comprising a countersink perpendicular to the plane of the base and open relative to the upper surface, and secant with said countersink and opposite the upper surface, a blind slot used to lock a rotating element in a bayonet fitting, said rotating element including at least one protruding portion cooperating with at least one aforementioned cavity.

In another advantageous embodiment, the peripheral rim and the rotating element each include a screw pitch enabling them to cooperate with each other.

BRIEF DESCRIPTION OF THE DRAWINGS

The objects, advantages and features of the invention will appear more clearly in the following detailed description of at least one embodiment of the invention, given solely by way of non-limiting example and illustrated by the annexed drawings, in which.

DETAILED DESCRIPTION

The present invention proceeds from the general inventive idea of providing an assembly for holding or supporting a timepiece balance spring allowing the stud to be more easily assembled/disassembled and allowing the stud to be placed very close to the balance staff in order to use balance springs with a small external diameter.

Figure 1:
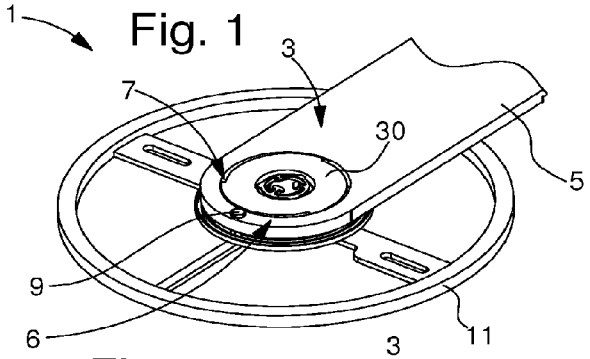
FIGS. 1 to 7 show a diagram of a preferred mode of a first embodiment of the holding assembly according to the invention.

FIG. 1 shows a schematic view of an assembly 1 for holding or supporting a timepiece balance spring according to a first embodiment. This holding assembly 1 includes a stud-holder 3 arranged to be attached to the balance-cock 5 by attachment means 7. The holding assembly also includes a balance spring stud 9 attached to one coil of the balance spring 11. Stud-holder 3 uses securing means 6 to secure stud 9 to cock 5.

Figure 2:
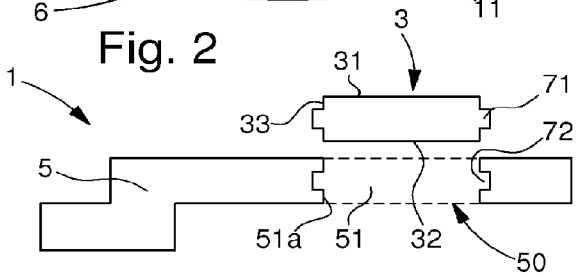

In a first embodiment, cock 5, also called the base, is provided with a housing 50. This housing 50 takes the form here of a through opening or orifice 51 in which stud-holder 3 is placed, said stud-holder 3 being maintained in its housing 50 via attachment means 7, as seen in FIGS. 1 and 2. Opening 51 has a peripheral rim 51*a* and is of circular shape. The stud-holder includes a rotating element used for securing the stud to the cock. Attachment means 7 include a male interface 71 arranged on outer edge 33 of the rotating element and a female interface 72 arranged on peripheral rim 51*a*. These male and females interfaces 71, 72 thus cooperate together to allow the rotating element to be mounted in housing 51 via a rotational motion of said rotating element relative to cock 5. This assembly via a rotational motion is used to lock the stud in housing 50. Assembly via a rotational motion causes the stud to press on the peripheral rim. The rotating element, the housing and the attachment means form securing means 6. To achieve this, two solutions are envisaged.

Figure 5:
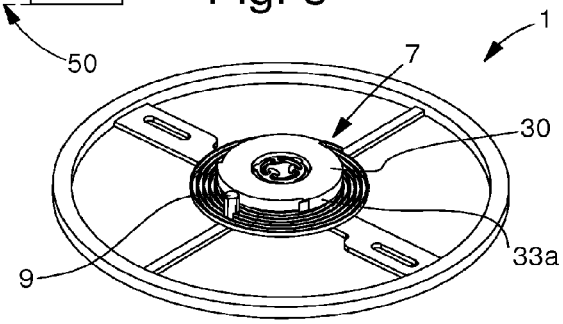
Figure 6:
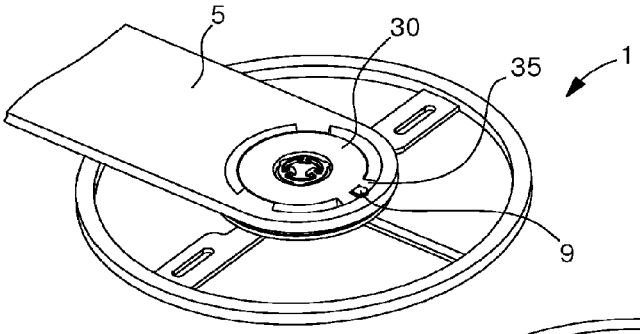
Figure 7:
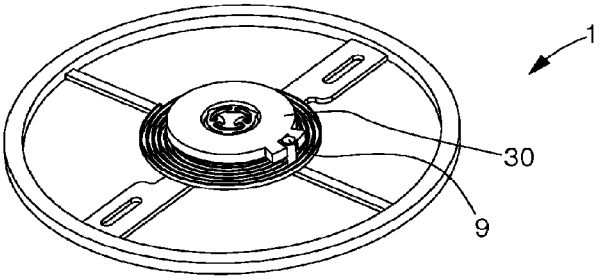

In a preferred mode of this first embodiment seen in FIGS. 5, 6 and 7, the rotating element takes here the form of a central hub 30, which includes an upper face 31, a lower face 32 and an outer edge 33. This central hub 30 is of similar shape to that of the opening, i.e. circular.

Figure 3:
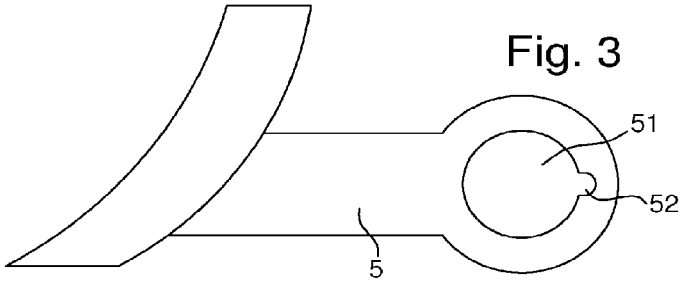

In a first solution seen in FIGS. 1 and 3, the peripheral rim 51*a* is provided with a through notch 52 whose dimensions are similar to those of stud 9 so that the latter can be placed therein. During assembly, stud 9 is initially placed in notch 52 of peripheral rim 51*a*. Then, hub 30 is fixed in its housing 51, by engaging male interface 71 of hub 30 with female interface 72 of peripheral rim 51*a*. Hub 30 is then secured by rotation, which causes a contact between its outer edge 33 and stud 9. The stud is thus pressed onto peripheral rim 51*a* and locked. This solution allows the stud to be placed in a fixed position.

In a variant of this first solution seen in FIG. 1, hub 30 has an irregular shape so that the outer edge 33 in contact with stud 9 is not perfectly circular. Thus, outer edge 33 in contact with stud 9 includes a substantially triangular set back portion and forms a gentle slope. When hub 30 is rotated and secured in housing 50, this configuration makes it possible to even out the increase in stress applied to stud 9 in order to lock it.

Figure 4:
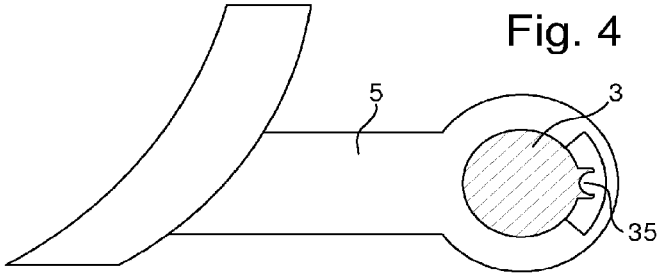

In a second solution seen in FIG. 4, hub 30 is provided with a through notch 35 whose dimensions are similar to those of stud 9 so that the latter can be placed therein. During assembly, stud 9 is initially placed in notch 35 of hub 30. Then, hub 30 is secured inside its housing 51 by engaging male interface 71 of hub 30 with female interface 72 of peripheral rim 51*a*. Hub 30 is then secured by rotation which causes a contact between peripheral rim 51*a* and stud 9. The stud is thus pressed onto peripheral rim 51*a* and locked. This solution makes it possible to obtain a stud 9 whose position is angularly adjustable about the balance staff and thus allows adjustment of the position of the stud 9.

In a variant of this second solution, as seen in FIG. 4, peripheral rim 51*a* has an irregular shape so that it is not perfectly circular. Thus, peripheral rim 51*a* includes a substantially triangular set back portion and forms a gentle slope. When the rotating element, i.e. hub 30, is rotated and secured in housing 50, this configuration makes it possible to even out the increase in stress applied to the stud in order to lock it.

In another preferred mode, the rotating element takes the form here of a ring 300. This ring 300 includes an upper face 301, a lower face 302, an outer edge 303 and an inner edge 304.

Rotating element 3 is advantageously used as a multi-functional hub. Thus, central hub 30 is arranged to include a shock absorber system 100, as seen in FIGS. 1, 5, 6 and 7. The central hub thus includes a through or blind recess 101, which houses shock absorber system 100. A through recess 101 allows said shock absorber system 100 to be visible and thus improves aesthetics.

Figure 8:
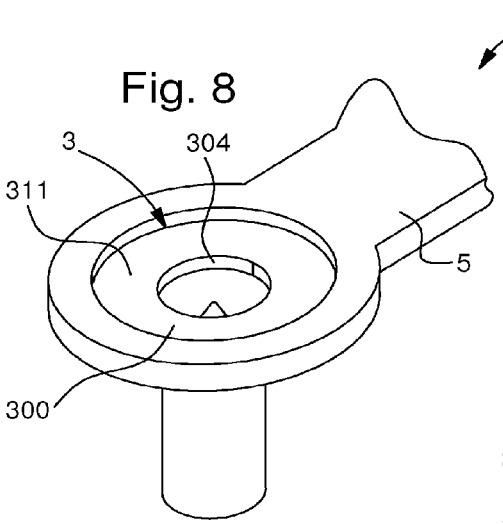
FIG. 8 shows a diagram of another version of the first embodiment of the holding assembly according to the invention.

In the case of a ring 300 as seen in FIG. 8, the central orifice may be used to place a shock absorber system 100 therein.

Shock absorber system 100 may take a conventional form, that is to say a setting in which a jewel hole and an endstone are arranged, or the form of a single jewel. This single jewel is provided with a recess for cooperating with the balance staff and may be pressed into the hub hole or mounted via an elastic ring. Shock absorber system 100 could also take the form of a disc provided with elastic arms. One advantage of this configuration is that it provides a centered system, since the position of the stud is centred relative to the balance staff cooperating with the shock absorber system. Further, this provides an easy-to-assemble, multifunctional system acting as stud-holder 3 and shock absorber 100. Shock absorber system 100 may be pre-mounted on the hub prior to final assembly with stud 9.

Of course, shock absorber system 100 might not incorporated in hub 30, but arranged on cock 5 in an off-centre position relative to central hub 30. This configuration allows the use of a sprung balance assembly of large diameter without necessarily having a large hub 30.

Figure 9:
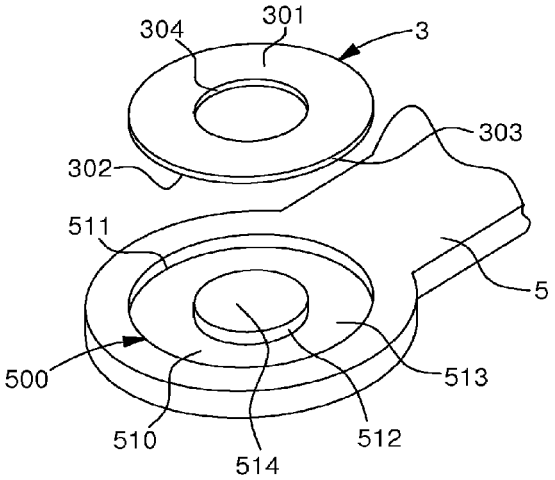
FIG. 9 shows a diagram of a second embodiment of the holding assembly according to the invention.

In a second embodiment visible in FIG. 9, cock 5 includes a housing 500. This housing 500 takes the form here of a circular hollow 510 formed of a peripheral rim 511, an inner rim 512 and a bottom 513. Inner rim 512 forms a central island or central circular portion 514 protruding from bottom 513 of housing 500. Rotating element 3 takes the form here of a ring 300. This ring comprises an upper face 301, a lower face 302, an outer edge 303 and an inner edge 304. Rotating ring 300 will be placed in said circular hollow 510.

In this embodiment, attachment means 7 comprise a male interface 701 arranged on an edge of ring 300 and a female interface 702 arranged on one of the rims of housing 500. Male interface 701 could be arranged on outer edge 303 of ring 300, whereas female interface 702 will be arranged on peripheral rim 511 of housing 500. However, male interface 701 could be arranged on inner edge 304 of ring 300, whereas female interface 702 will be arranged on inner rim 512 of housing 500.

These male and females interfaces 701, 702 thus cooperate together to allow ring 300 to be mounted via a rotational motion relative to housing 500. This assembly via a rotational motion is used to lock stud 9 in housing 500. Assembly via a rotational motion causes the stud to press on a rim of the housing.

Figure 10:
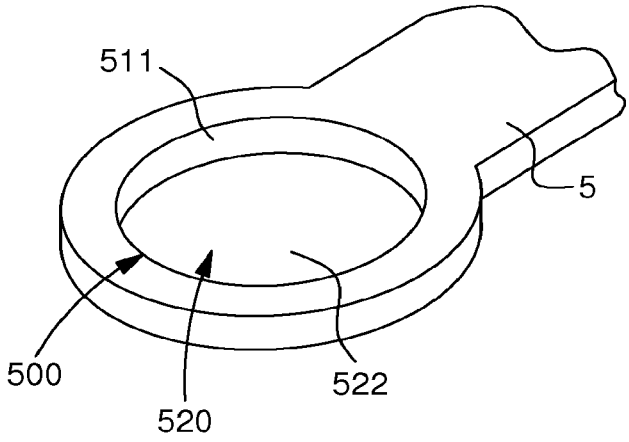
FIG. 10 shows a diagram of a third embodiment of the holding assembly according to the invention.

In a third embodiment visible in FIG. 10, cock 5 includes housing 500. Housing 500 takes the form here of a circular hollow 520 formed of a peripheral rim 521 and a bottom 522. The rotating element may take the form here of a hub 30 as described in the first embodiment, or a ring 300 as described in the first embodiment.

In this third embodiment, attachment means 7 include a male interface 701 arranged on outer edge 303 of the rotating element and a female interface 702 arranged on peripheral rim 521. These male and females interfaces 701, 702 thus cooperate together to allow the rotating element to be mounted in housing 500 via a rotational motion of said rotating element relative to cock 5. This assembly via a rotational motion is used to lock stud 9 in housing 500. Assembly via a rotational motion causes stud 9 to press on the peripheral rim.

In the second and third embodiment, a notch for housing the stud is provided.

Figure 11:
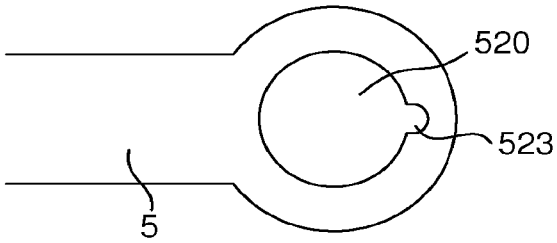
FIGS. 11 to 13 show a diagram of a first solution of the second and third embodiments according to the invention.
Figure 12:
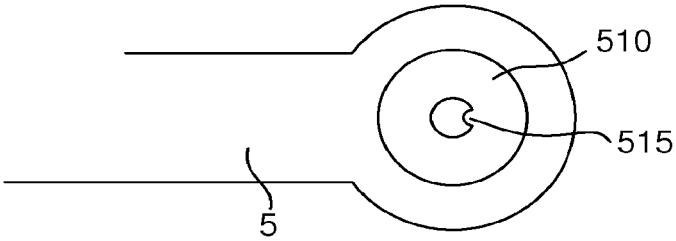
Figure 13:
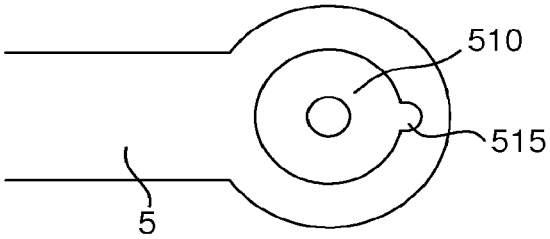

According to a first solution seen in FIGS. 11 to 13, stud 9 is mounted in a non-adjustable fixed position on the stud-holder. Thus, a through notch 515, 523 is arranged on peripheral rim 511, 521 or on inner rim 512. Stud 9 is then initially placed in notch 515, 523, and then the rotating element is fixed in its housing 510, 520 by engaging male interface 701 with female interface 702. Rotating element 3 is then rotated which causes a contact between one of the edges of the rotating element and stud 9. The stud is thus pressed into notch 515, 523 and locked. This solution allows the stud to be placed in a fixed position.

In a variant of this first solution, the rotating element has an irregular shape so that the outer edge 33,303 in contact with stud 9 is not perfectly circular. Thus, the edge in contact with stud 9 includes a substantially triangular set back portion and forms a gentle slope. When the rotating element is rotated and secured in the housing, this configuration makes it possible to even out the increase in stress applied to stud 9 in order to lock it.

Figure 14:
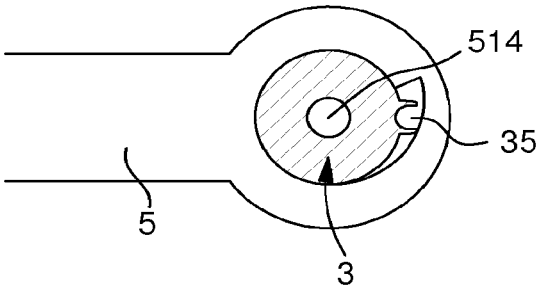
FIGS. 14 to 16 show a diagram of a second solution of the second and third embodiments according to the invention.
Figure 15:
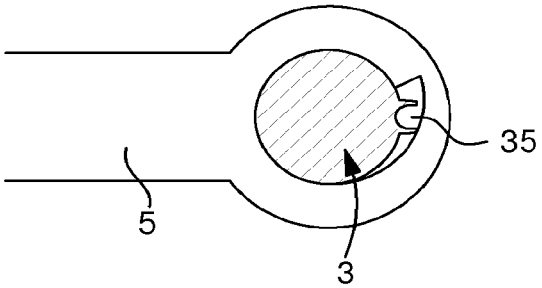
Figure 16:
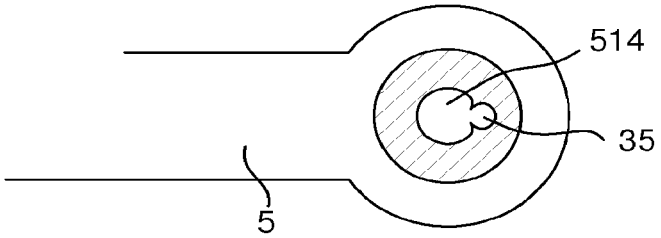

In a second solution seen in FIGS. 14 to 16, the stud is mounted in an adjustable position on the stud-holder. In this solution, the rotating element is thus provided with a notch 35 whose dimensions are similar to those of the stud so that the latter can be placed therein. Housing 500 further includes a through portion so that stud 9 can pass therethrough and emerge in housing 500, so that the stud can be fixed to the balance spring and inserted in notch 35. This notch 35 for stud 9 can be arranged on outer edge 303 of ring 300 or on inner edge 304. This through portion will have the shape of a circular groove.

During assembly, stud 9 is initially placed in notch 35 of the rotating element. Then, the rotating element is fixed in its housing 500, by engaging male interface 701 with female interface 702. The rotating element is then rotated and causes a contact between peripheral rim 511 and stud 9 or between inner rim 512 and the stud. The stud is thus pressed and locked. The circular groove shape of the through portion of housing bottom 513 allows stud 9 to be placed in the notch of the rotating element and rotatable assembly of the latter.

Of course, it will be understood that the ring notch may or may not protrude so as to gain size.

In a variant of this second solution, the peripheral or inner rim has an irregular shape so that it is not perfectly circular. Thus, the peripheral or inner rim includes a substantially triangular set back portion and forms a gentle slope. When the rotating element is rotated and secured in the housing, this configuration makes it possible to even out the increase in stress applied to the stud in order to lock it.

Figure 17:
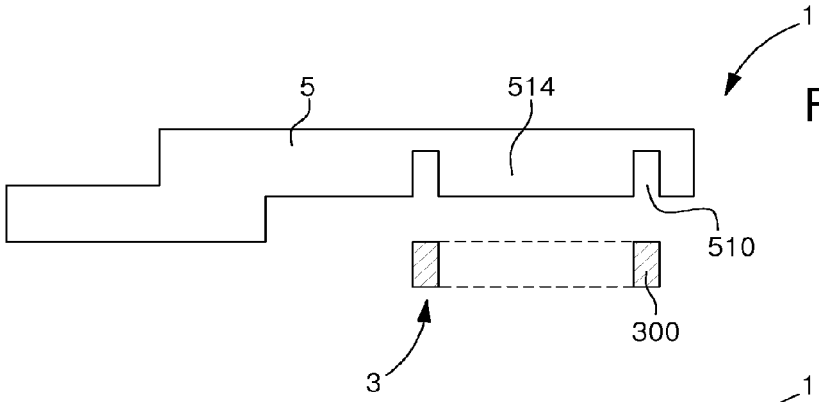
FIGS. 17 to 19 show a diagram of a first variant of the second and third embodiments according to the invention.
Figure 18:
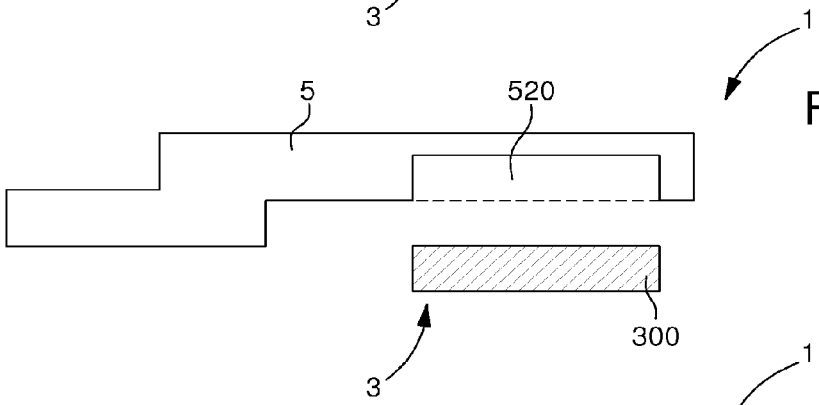
Figure 19:
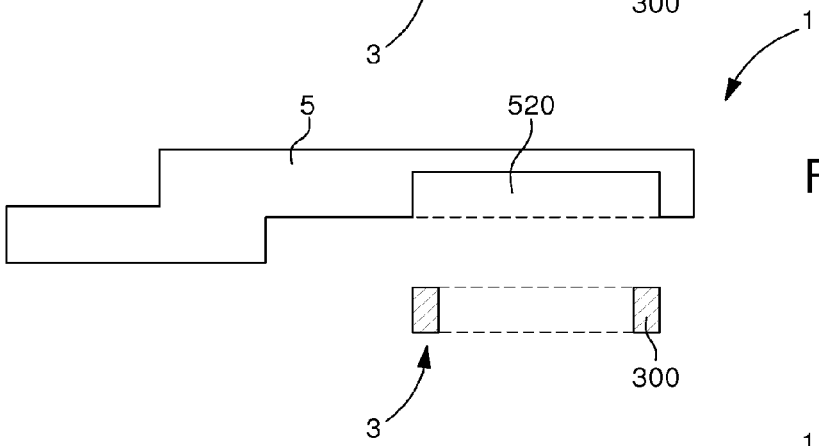

In a first variant of the second embodiment or of the third embodiment seen in FIGS. 17 to 19, it is possible to envisage that housing 500 is arranged on the lower face of the cock. Indeed, cock 5 has an upper face, which is visible when cock 5 is assembled, and a lower face. This lower face is generally the face on which the balance staff is fixed. The housing of cock 5 is thus arranged on this lower face. In the second and third embodiments, this means that it is not necessary to have a partly through bottom in order for the stud to be fixed in the rotating element notch and fixed to the balance spring. A perfectly smooth visible face of the cock is thus obtained for forming decorations.

In a second variant of the second embodiment or of the third embodiment seen in FIGS. 20 to 23, there is provided a shock absorber system 100. The latter may take a conventional form, that is to say a setting in which a jewel with a hole and an endstone are arranged, or the form of a single jewel. This single jewel is provided with a recess for cooperating with the balance staff and may be force-fitted into the hub hole or mounted via an elastic ring. Shock absorber system 100 could also take the form of a disc provided with elastic arms.

Figure 20:
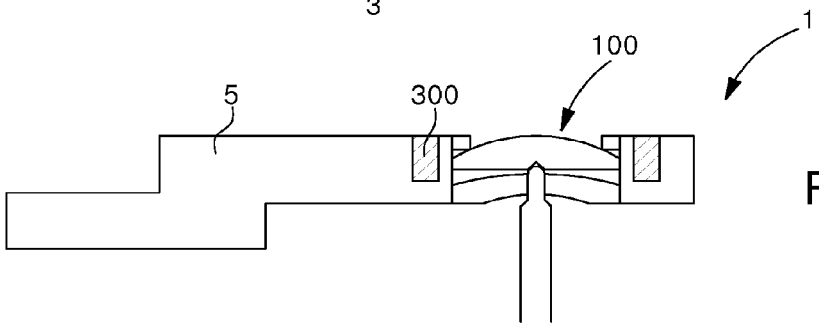
FIGS. 20 to 23 show a diagram of a second variant of the second and third embodiments according to the invention.

In the case where the housing is arranged on the visible face of the cock seen in FIG. 20, the underside of the housing bottom includes a recess in which said shock absorber system 100 is arranged. If the housing is provided with a protruding portion formed by the inner rim, the recess for shock absorber system 100 will be placed on this protruding portion or central island allowing for perfect centring.

In the case where the housing is arranged on the non-visible face of the cock, there are several possibilities.

Figure 22:
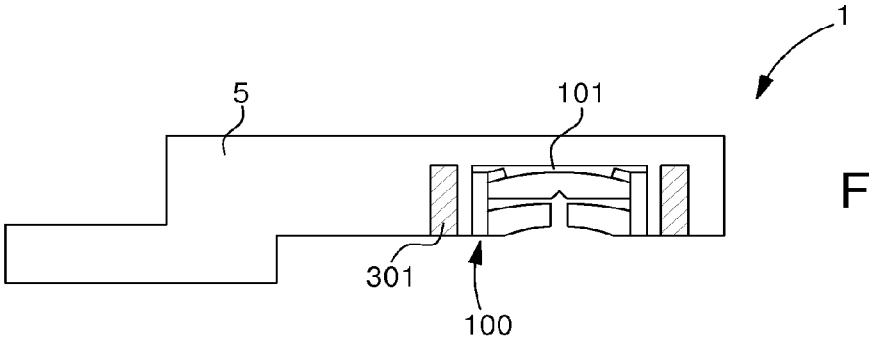

In the case of a housing provided with an inner rim forming a protruding portion or central island as seen in FIG. 22, the recess for the shock absorber system will be created on this central island.

Figure 21:
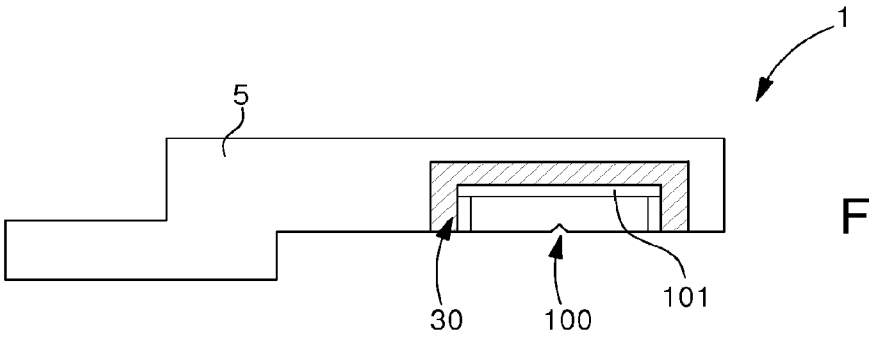

In the case where the housing is provided with a peripheral rim and a bottom and where the rotating element is a hub as seen in FIG. 21, the recess for shock absorber system 100 will be arranged on said hub.

Figure 23:
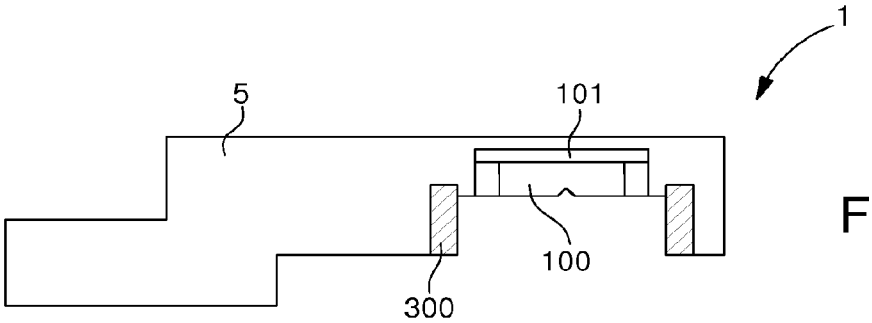

In the case where the housing is provided with a peripheral rim 511 and a bottom 513 and where the rotating element is a ring 300 as seen in FIG. 23, the recess for shock absorber system 100 will be arranged on the bottom of said housing 500, such that the balance staff bearing the balance spring passes through said ring 300.

Figure 24:
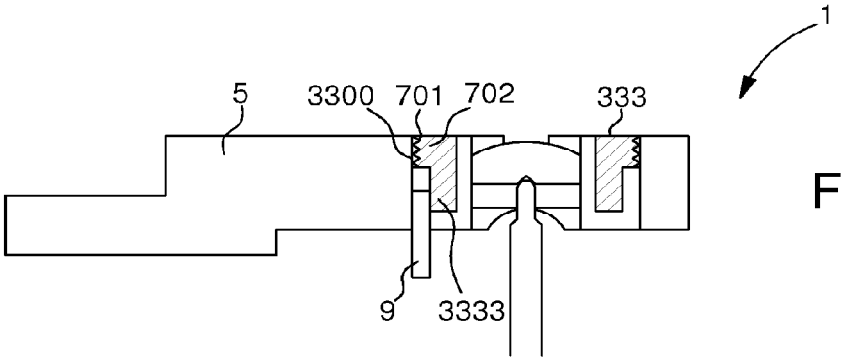
FIG. 24 shows a diagram of a variant of the ring used in the various embodiments of the holding assembly according to the invention.

In a variant of the different embodiments in which the rotating element is a ring and as seen in FIG. 24, rotating ring 300 is a ring with several levels 333. More specifically, the rotating ring includes 2 levels 333*a*, 333*b*. To achieve this, rotating ring 300 would be similar to a tube having a constant internal diameter and a variable external diameter. First level 333*a* having the largest diameter would carry male interface 702, whereas second level 333*b* having the smallest diameter would be used for locking stud 9. This variant allows the attachment portion of the stud and the attachment portion in the housing to be separated and to bring the stud closer to spinal.

For rotatable mounting of the rotating element in the different embodiments, male interfaces 71, 701 and female interfaces 72, 702 thus cooperate with each other in order to mount the central hub in the housing by a rotational motion of the hub relative to the housing.

According to a first alternative embodiment, the rotatable mounting is a bayonet fitting. To achieve this, female interface 702 is formed by at least one cavity comprised in the thickness of the peripheral rim. This cavity is formed by a countersink, which is parallel to said central hub axis and open on the upper surface, and a blind slot, which is secant with said first countersink and opposite to the upper surface. This slot is used to lock the rotating element in a bayonet fitting.

Male interface 71, 701, located on the rotating element, consists of at least one protruding portion. This protruding portion is located on the outer edge of the rotating element. The protruding portion is arranged to cooperate with the female interface.

The rotating element is mounted in the housing such that the protruding portions can be inserted in the countersink The rotating element can then be inserted in the housing. When the rotating element reaches an abutment position, the protruding portions must be facing the slots. Consequently, a movement of rotation is effected to insert the protruding portions into said slots and to fix said rotating element in the cock.

According to a second alternative, the rotatable mounting is a screw mounting. Thus, the female interface is formed by a screw pitch comprised in the peripheral rim. The male interface, located on the rotating element, also consists of a screw pitch. The screw pitch is arranged to cooperate with the female interface.

Of course, other types of assembly may be used, such as for example pressing-in or adhesive bonding, but they cannot be disassembled like the bayonet fitting or screws.

It will be clear that various alterations and/or improvements and/or combinations evident to those skilled in the art may be made to the various embodiments of the invention set out above without departing from the scope of the invention defined by the annexed claims.

What is claimed is:

1. An assembly for holding or supporting a timepiece balance spring including a cock provided with an upper surface and a lower surface on which a balance spring stud and a stud-holder are arranged, wherein the stud-holder includes:

means for securing said stud to the cock, the means for securing said stud comprising an orifice traversing said cock and provided with a peripheral rim to form a housing for insertion of the stud, wherein said means for securing said stud also include a rotating element comprising attachment means for rotatable attachment thereof inside the housing, said rotating element having an outer edge cooperating with the stud to lock said stud between the outer edge of the rotating element and the peripheral rim of the housing when the rotating element is assembled in the housing, and wherein the peripheral rim or the rotating element is provided with a through notch in order to place the stud therein.

2. The holding assembly according to claim 1, wherein said rotating element is a hub.

3. The holding assembly according to claim 2, wherein the hub includes a shock absorber system.

4. The holding assembly according to claim 1, wherein said rotating element is a ring.

5. An assembly for holding or supporting a timepiece balance spring including a cock provided with an upper surface and a lower surface on which a balance spring stud and a stud-holder are arranged, wherein the stud-holder includes:

means for securing said stud to the cock, the means for securing said stud including a blind circular hollow formed by a bottom and a peripheral rim, arranged on the upper face of the cock forming a housing for insertion of the stud, wherein said means for securing said stud also include a rotating element comprising attachment means for rotatable attachment thereof inside the housing, said rotating element having an outer edge cooperating with the stud to lock the stud between the outer edge of the rotating element and the peripheral rim of the housing when the rotating element is assembled in the housing.

6. The holding assembly according to claim 5, wherein said rotating element is a hub.

7. The holding assembly according to claim 5, wherein said rotating element is a ring.

8. The holding assembly according to claim 7, wherein the housing Lou circular hollow, formed of a peripheral rim, an inner rim and a bottom, in which the rotating element is inserted, the inner rim defining a central portion protruding from the bottom.

9. The holding assembly according to claim 8, wherein the inner rim is provided with a through notch cooperating with a hole located in the housing bottom in order to place the stud therein.

10. The holding assembly according to claim 5, wherein the peripheral rim is provided with a through notch in order to place the stud therein.

11. The holding assembly according to claim 5, wherein said rotating element is provided with a through notch cooperating with a hole located in the housing bottom in order to place the stud therein.

12. The holding assembly according to claim 5, wherein the bottom of the housing includes a shock absorber system.

13. An assembly for holding or supporting a timepiece balance spring including a cock provided with an upper surface and a lower surface on which a balance spring stud and a stud-holder are arranged, wherein the stud-holder includes:

means for securing said stud to the cock, the means for securing said stud including a blind circular hollow formed by a bottom and a peripheral rim, arranged on the lower face of the cock forming a housing for insertion of the stud, wherein said means for securing said stud also include a rotating element comprising attachment means for rotatable attachment thereof inside the housing, said rotating element having an outer edge cooperating with the stud to lock the stud between the outer edge of the rotating element and the peripheral rim of the housing when the rotating element is assembled in the housing.

14. The holding assembly according to claim 13, wherein said rotating element is a hub.

15. The holding assembly according to claim 14, wherein the hub includes a shock absorber system.

16. The holding assembly according to claim 13, wherein said rotating element is a ring.

17. The holding assembly according to claim 16, wherein the housing is a circular hollow, formed of a peripheral rim, an inner rim and a bottom, in which the rotating element is inserted, the inner rim defining a central portion protruding from the bottom.

18. The holding assembly according to claim 17, wherein the inner rim is provided with a notch in order to place the stud therein.

19. The holding assembly according to claim 18, wherein the central portion includes a shock absorber system.

20. The holding assembly according to claim 16, wherein the bottom of the housing includes a shock absorber system, a balance staff passing through the ring acting as a rotating element.

21. The holding assembly according to claim 13, wherein the peripheral rim is provided with a notch in order to place the stud therein.

22. The holding assembly according to claim 13, wherein said rotating element is provided with a notch in order to place the stud therein.

23. An assembly for holding or supporting a timepiece balance spring including a cock provided with an upper surface and a lower surface on which a balance spring stud and a stud-holder are arranged, wherein the stud-holder includes:

means for securing said stud to the cock, the means for securing said stud comprising an orifice traversing said cock and provided with a peripheral rim to form a housing for insertion of the stud, wherein said means for securing said stud also include a rotating element comprising attachment means for rotatable attachment thereof inside the housing, said rotating element having an outer edge cooperating with the stud to lock said stud between the outer edge of the rotating element and the peripheral rim of the housing when the rotating element is assembled in the housing, and wherein the peripheral rim includes at least one cavity comprising a countersink perpendicular to the plane of a base and open relative to the upper surface, and, secant with said countersink and opposite the upper surface, a blind slot used to lock the rotating element in a bayonet fitting, said rotating element including at least one protruding portion cooperating with said at least one cavity.

24. An assembly for holding or supporting a timepiece balance spring including a cock provided with an upper surface and a lower surface on which a balance spring stud and a stud-holder are arranged, wherein the stud-holder includes:

means for securing said stud to the cock, the means for securing said stud comprising an orifice traversing said cock and provided with a peripheral rim to form a housing for insertion of the stud, wherein said means for securing said stud also include a rotating element comprising attachment means for rotatable attachment thereof inside the housing, said rotating element having an outer edge cooperating with the stud to lock said stud between the outer edge of the rotating element and the peripheral rim of the housing when the rotating element is assembled in the housing, and wherein the peripheral rim and the rotating element each include a screw pitch enabling them to cooperate with each other.

* * * * *